United States Patent [19]

Wright

[11] 4,205,543

[45] Jun. 3, 1980

[54] SPRING WINDER

[75] Inventor: Richard D. Wright, Kenosha, Wis.

[73] Assignee: Snap-On Tools Corporation, Kenosha, Wis.

[21] Appl. No.: 929,526

[22] Filed: Jul. 31, 1978

[51] Int. Cl.[2] ..... B21F 3/04

[52] U.S. Cl. ..... 72/138; 72/143; 140/124

[58] Field of Search ..... 72/135, 138, 140, 142, 72/143, 144; 140/124

[56] References Cited

U.S. PATENT DOCUMENTS

| | | | |
|---|---|---|---|
| 952,582 | 3/1910 | Ritter | 72/143 |
| 1,013,239 | 1/1912 | Titus | 72/143 |
| 1,403,372 | 1/1922 | Armstrong | 72/143 |
| 1,671,983 | 6/1928 | Faust | 72/143 |
| 2,367,320 | 1/1945 | Walters | 140/124 |
| 2,592,590 | 4/1952 | Oberg | 72/143 |
| 2,650,638 | 9/1953 | Johnson et al. | 72/143 |
| 3,423,980 | 1/1969 | Ludwig et al. | 72/138 |
| 3,807,210 | 4/1974 | Richert et al. | 72/138 |

FOREIGN PATENT DOCUMENTS

| | | | |
|---|---|---|---|
| 349177 | 3/1922 | Fed. Rep. of Germany | 72/142 |
| 958797 | 12/1947 | France | 140/124 |
| 679582 | 9/1952 | United Kingdom | 72/142 |
| 777736 | 6/1957 | United Kingdom | 72/138 |

*Primary Examiner*—Ervin M. Combs

*Attorney, Agent, or Firm*—Vogel, Dithmar, Stotland, Stratman & Levy

[57] ABSTRACT

A spring winder includes a base and a mandrel rotatably held against the base by a pair of mounting blocks which include aligned grooves in which the mandrel is seated. Each block is connected to the base by a pair of mounting screws which cooperate with associated compression springs for resiliently holding the mandrel between the mounting blocks and the base with a variable force. A length of spring wire is fed between a cam and washer rotatably mounted on the side of the base by means of an adjustment screw, the wire then being fed through an aperture in the adjacent end of the mandrel. The cam and washer are resiliently urged together by a compression spring for applying a drag to the wire which is variable by adjustment of the associated screw. A pin on the washer rides in a complementary groove in the cam for retaining the wire in position. As the mandrel is rotated the wire is wound thereon against the drag of the cam and washer to form a series of helical coils. The cam has a wedge-shaped camming surface thereon which is insertable between adjacent coils of the wire on the mandrel to establish the spacing between adjacent coils. Rotation of the cam permits adjustment of this spacing. A double-wedge cam is also disclosed for forming either right-hand or left-hand springs.

10 Claims, 14 Drawing Figures

SPRING WINDER

BACKGROUND OF THE INVENTION

The present invention relates to apparatus for forming a helical spring from a length of spring wire and, more particularly, to a simple bench-mountable device, preferably hand-operated, for custom making small quantities of springs.

While spring manufacturing devices are known in the art, they are generally quite complicated and expensive and are typically designed for mass-producing large quantities of springs. There has not heretofore been available a simple and inexpensive tool to allow an artisan or craftsman to manufacture small quantities of helical springs as needed, while at the same time affording the flexibility of making a wide variety of helical springs of different coil diameters, including right-hand and left-hand, tension and compression, closed end and open end springs, all from wire of different diameters, material and resilient characteristics.

Prior devices have either been too cumbersome or too expensive for small scale use or have not afforded the desired flexibility.

SUMMARY OF THE INVENTION

The present invention is directed to spring winding apparatus which is simple and compact and is suitable for bench mounting and is uniquely adapted for custom making of limited numbers of springs.

The present invention provides a spring winding apparatus which is preferably hand-operated for forming a wide variety of types of helical springs from lengths of spring wire.

More particularly, the present invention permits formation of helical springs having a variety of different coil diameters and made from a variety of different thicknesses of wire. The invention also selectively permits the formation of right-hand or left-hand springs of either the tension or compression variety having open or closed ends.

The present invention also provides a spring winding apparatus which permits the spacing between spring coils to be selectively varied from zero to some predetermined maximum spacing.

The present invention also permits ready adjustment of the tension on the spring wire for assisting in control of the coil diameter of the finished spring.

Another feature of the invention is the provision of means for adjusting the tightness with which the mandrel is held in place.

Further features of the invention pertain to the particular arrangement of the parts of the spring winder whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 3 is a top plan view of the front side of the spring winder apparatus of FIG. 1, shown disposed horizontally as it might be when mounted by C-clamps or the like;

DESCRIPTION OF THE PREFERRED EMBODIMENTS

Figure 1:
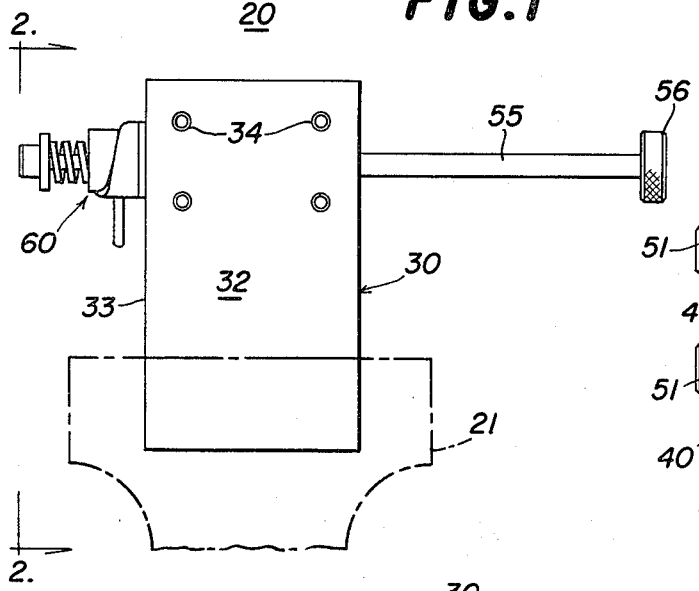
FIG. 1 is a rear elevational view of the spring winder constructed in accordance with and embodying the features of the present invention, shown mounted in a vise.
Figure 2:
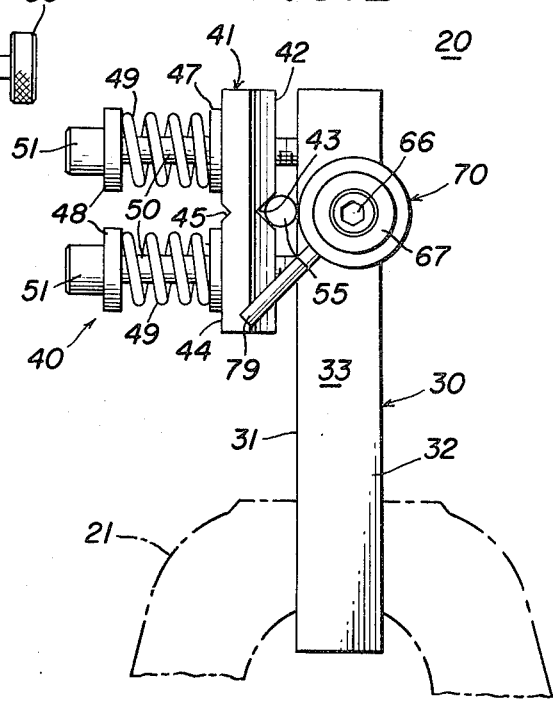
FIG. 2 is an enlarged side elevational view of the spring winder apparatus of FIG. 1, taken along the line 2—2.
Figure 3:
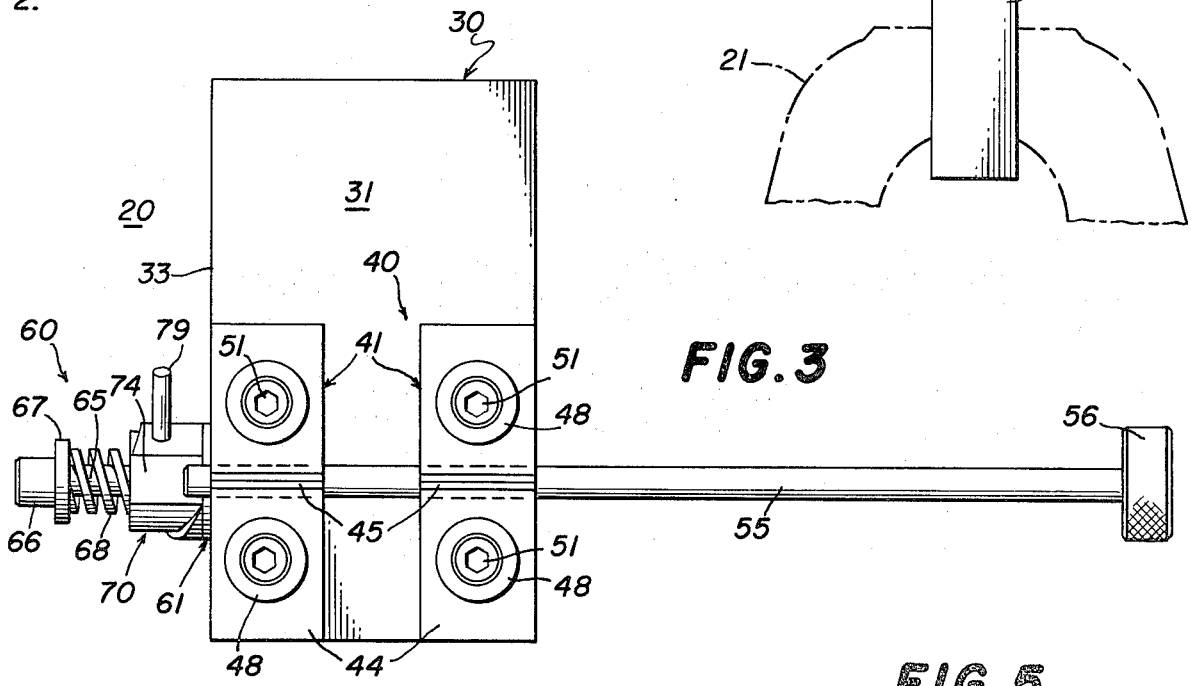
Figure 10:
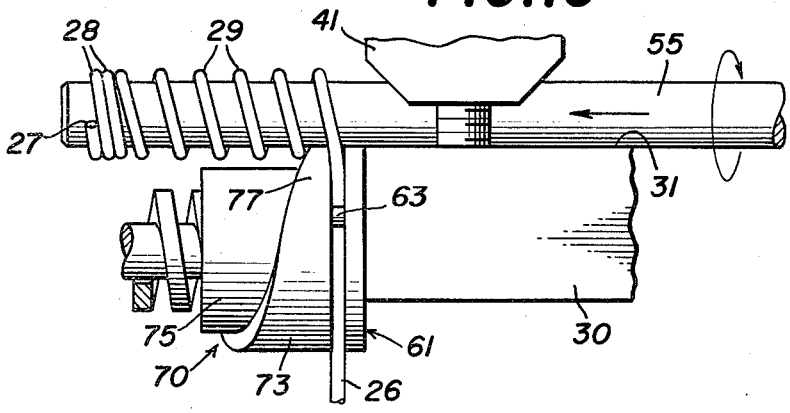
FIG. 10 is a view similar to FIGS. 6 and 8, illustrating the position of the apparatus after a number of helical coils of the spring wire have been wound around the mandrel and also illustrating the manner in which the cam controls spacing of the spring coils.
Figure 11:
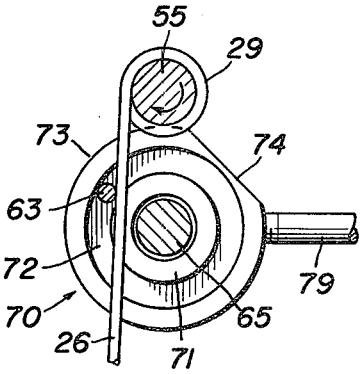
FIG. 11 is a view similar to FIGS. 7 and 9 of the apparatus in the position illustrated in FIG. 10.

Referring now to FIGS. 1 through 5 of the drawings, there is illustrated a spring winder apparatus, generally designated by the numeral 20, which is adapted for bench mounting in a vise 21 or by C-clamps (not shown) or the like for forming a helical spring from a length of spring wire 26 (see FIG. 10). The spring winder 20 includes a generally flat rectangular base plate 30 having opposed rectangular front and rear surfaces 31 and 32 interconnected at the margins thereof by a side surface 33. The base plate 30 may be oriented vertically, as illustrated in FIGS. 1 and 2, for mounting in a vise 21 or, alternatively, may be disposed horizontally for mounting with C-clamps or the like, as illustrated in FIG. 3.

The base plate 30 includes two pairs of internally threaded bores 34 (FIG. 1) extending therethrough adjacent to one end thereof in a rectangular arrangement and further includes an internally threaded hole 35 (FIG. 6) extending into the side surface 33 along one of the long sides of the base plate 30 substantially perpendicular to the axes of the bores 34 and approximately midway between the upper and lower ones thereof.

There is also provided a mandrel mounting assembly, generally designated by the numeral 40 (FIGS. 2–4) which includes two identically-constructed mounting blocks 41, each preferably being generally trapezoidal in transverse cross section and having a small rectangular rear surface 42 having a relatively large V-shaped groove extending laterally thereacross and a relatively large rectangular front surface 44 having a relatively small V-shaped groove 45 extending laterally thereacross parallel to the groove 43.

Each of the blocks 41 also includes a pair of bores 46 (FIG. 8) extending therethrough from the front surface 44 to the rear surface 42 and respectively disposed on opposite sides of the grooves 43 and 45 and equidistantly spaced therefrom. Each of the mounting blocks 41 is secured to the base plate 30 by a pair of screws 50 which respectively extend through the bores 46 and are threadedly engaged in a complementary pair of the bores 34 in the base 30 so that the longitudinal axis of the mounting block 41 extends substantially parallel to the longitudinal axis of the base plate 30.

The mounting blocks are arranged so that the same surface (front or rear) of each faces the front surface 31 of the base plate 30. For purposes of illustration, the mounting blocks 41 have been shown with the rear surfaces 42 thereof facing the front surface 31 of the base plate 30, in which arrangement the large grooves 43 are disposed in alignment with each other adjacent the base plate 30. Each of the screws 50 has an enlarged head 41 thereon which is preferably a socket head. Disposed coaxially around each of the screws 50 and trapped thereon between the head 51 and the mounting block 41 is a stepped retaining washer 47 disposed against the mounting block 41, a retaining washer 48 disposed against the screw head 51 and a helical tension spring 47 retained between the washers 47 and 48. Thus, it will be appreciated that the compression springs 49 serve to urge the mounting blocks 41 toward the base plate 30 with a force which varies with the adjustment of the screws 50.

There is also provided an elongated mandrel 55, circular in transverse cross section, provided adjacent to one end thereof with a handle 56 and provided adjacent to the other end thereof with a cylindrical bore or aperture 57 (FIG. 6) extending diametrically therethrough. The handle 56 is illustrated in the drawings as being a knurled knob, but it will be appreciated that other types of handles such as cranks or the like could be used.

For mounting the mandrel 55 on the base plate 30, the screws 50 of the mandrel mounting assembly 40 are backed off until the rear surfaces 42 of the mounting blocks 41 are spaced from the front surface 31 of the base plate 30 a distance approximately equal to the diameter of the mandrel 55. Then, the leading end of the mandrel 55, i.e., the end with the bore 57 therethrough, is inserted between the mounting blocks 41 and the base plate 30 along the grooves 43 until the bore 57 is disposed just beyond the side surface 33 of the base plate 30 in which the hole 35 is formed (see FIG. 6). The screws 50 are then tightened until the mandrel 55 is held between the mounting blocks 41 and the base plate 30 sufficiently tightly that the mandrel 55 cannot slip out from therebetween or wobble, but loose enough to permit axial and rotational movement of the mandrel 55 by manual operation of the handle 56.

Figure 4:
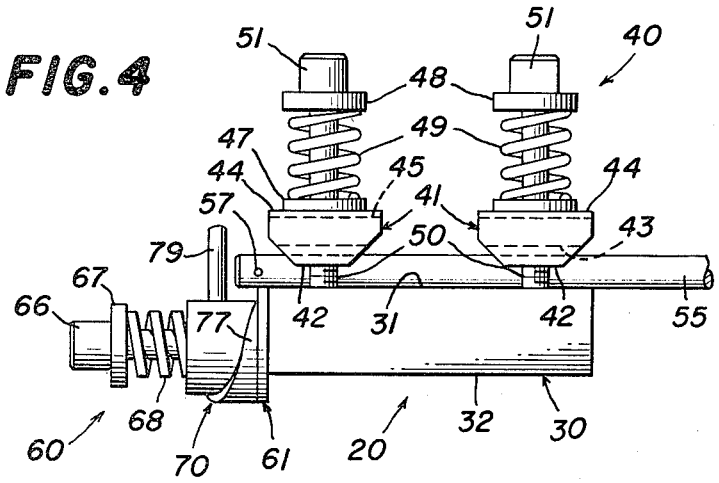
FIG. 4 is an enlarged fragmentary top plan view of the vise-mounted spring winder apparatus of FIG. 1.

The mandrel 55 may be provided in any of a number of different diameters for forming different diameter springs. When larger diameter mandrels 55 are used, the mounting blocks 41 are arranged with the large grooves 43 thereof facing the base plate 30, as illustrated in FIGS. 2 through 4, and when smaller diameter mandrels 55 are used, the mounting blocks 41 are reversed so that the small grooves 45 face the base plate 30. It will be appreciated that the maximum diameter of the mandrel 55 is limited by the vertical spacing between the screws 50. In other words, the maximum diameter of the mandrel 55 can be no greater than the vertical distance between the axes of the bores 34 less the diameter of a screw 50. It will also be appreciated that in place of the bore 57 the mandrel 55 could be provided with a slotted end for receiving an associated wire as described below.

Figure 6:
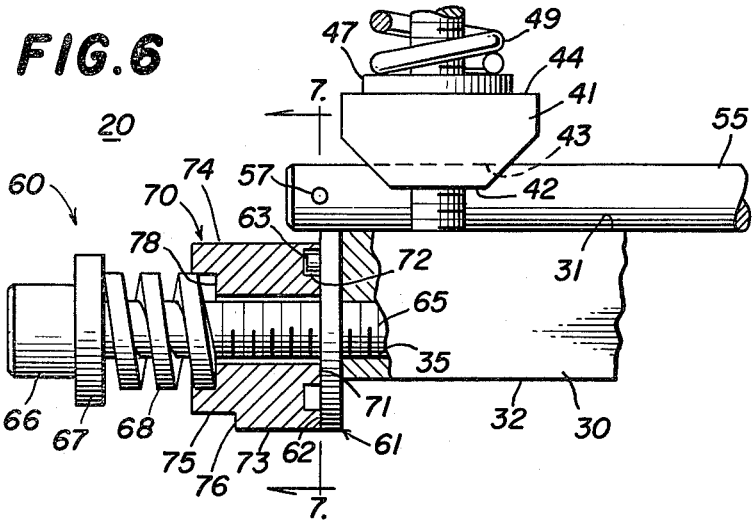
FIG. 6 is a further enlarged fragmentary view similar to FIG. 4, in partial section showing the spring winder apparatus of the present invention before insertion therein of a spring wire.
Figure 7:
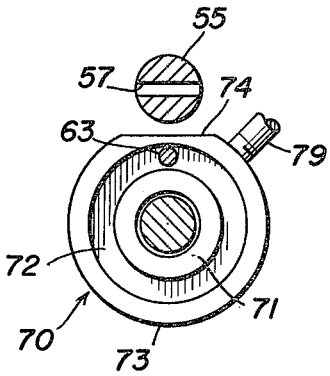
FIG. 7 is a fragmentary sectional view taken along the line 7—7 in FIG. 6.

Referring now also to FIGS. 6 and 7 of the drawings, the spring winder 20 includes a tension and spacing assembly, generally designated by the numeral 60 (FIG. 6), which includes a flat annular plate or washer 61 having a flat annular bearing surface 62 along one side thereof. Projecting from the bearing surface 62 parallel to the axis of the washer 61 and spaced a predetermined distance radially from the central aperture thereof is a short cylindrical pin 63.

The washer 61 is rotatably mounted on the base plate 30 by means of a screw 65 which has an enlarged head 66. Screw 65 passes through the aperture of the washer 61 and is threadedly engaged in the hole 35 in the base plate 30. Also disposed coaxially about the screw 65 are a retaining washer 67 which abuts the head 66 and a helical compression spring 68 which is trapped between washer 67 and a cam, generally designated by the numeral 70, which is also rotatably mounted on the screw 65 coaxially therewith.

Figure 5:
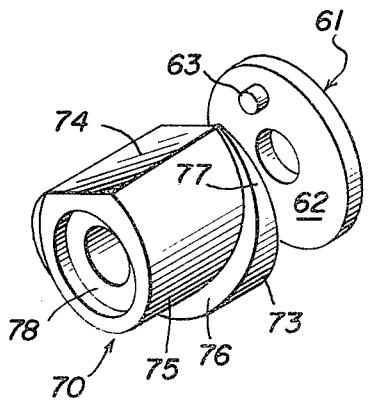
FIG. 5 is a further enlarged exploded perspective view of the tension and spacing cam and washer of the present invention.

The cam 70, best shown in FIG. 5, is generally cylindrical and is provided at one end thereof with a flat annular bearing surface 71 (FIGS. 6, 7, 9 and 11) disposed in facing relationship with the bearing surface 62 of the washer 61. Formed in the bearing surface 71 of cam 70 is an annular groove 72 dimensioned for receiving the pin 63 of the washer 61 and accommodating rotational movement of the washer 61 and cam 70 with respect to each other when the bearing surfaces 62 and 71 are closer together than the length of the pin 63.

The cam 70 has a part-cylindrical outer surface 73 which is truncated along one side thereof by a flat rectangular surface 74 substantially parallel to the axis of the cam 70. The part-cylindrical surface 73 is cut out or recessed as at 75 to form a helical ramp surface 76 which extends from one corner of the flat surface 74 where it intersects the bearing surface 71 and extends around to a termination at the diagonally opposite corner of the flat surface 74 at the other end of the cam 70. It will thus be appreciated that the helical surface 76 cooperates with the bearing surface 71 to define a spacing wedge for a purpose to be described more fully below.

Formed in the end surface of the cam 70 opposite the bearing surface 71 is an annular recess 78 for receiving therein the adjacent end of the compression spring 68 for maintaining the spring 68 coaxially in alignment with the screw 65. Preferably, the cam 70 is also provided with a short handle 79 extending substantially radially outwardly from the part-cylindrical outer surface 73 adjacent to the flat surface 74.

It will be noted that the radius of the part-cylindrical surface 73 is substantially equal to the distance between the axis of the threaded hole 35 and the front surface 31 of the base plate 30 so that, when the cam 70 is mounted in place as illustrated in FIGS. 1 through 4, 8 and 10, the part-cylindrical surface 73 will be substantially tangent to the mandrel 55 when rotated into facing relationship therewith.

Figure 8:
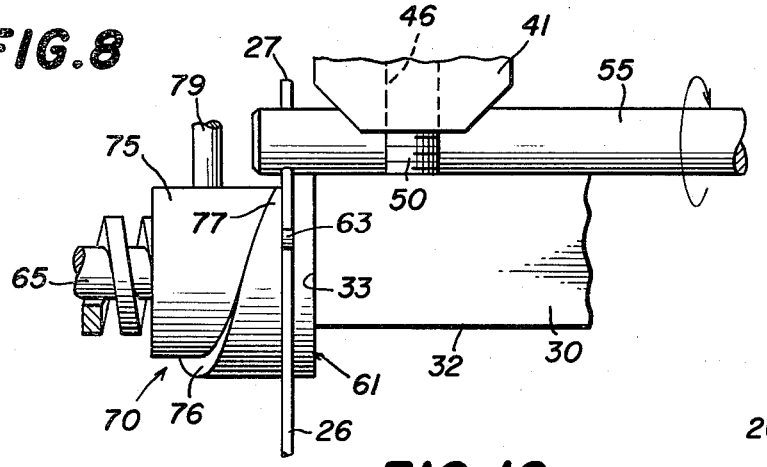
FIG. 8 is a fragmentary view similar to FIG. 6, illustrating the apparatus after insertion of the spring wire between the tension washer and cam and through the mandrel.
Figure 9:
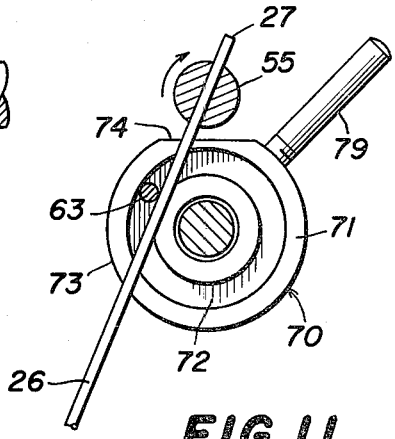
FIG. 9 is a view similar to FIG. 7 of the apparatus disposed in the position illustrated in FIG. 8.

The operation of the spring winder 20 in the winding of a spring from a length of spring wire 26 will now be described in detail. Referring in particular to FIGS. 6 through 11 of the drawings, after the mandrel 55 has been mounted in place in the manner described above, the screw 65 is backed off until the cam 70 can be spaced from the washer 61 a distance sufficient to allow insertion therebetween of the spring wire 26. More particularly, the washer 61 is preferably rotated so that the pin 63 thereof is disposed above the screw 65, i.e., between the screw 65 and the adjacent end of the base plate 30. Then, the leading end 27 of the spring wire 26 is inserted between the bearing surfaces 62 and 71 of the washer 61 and cam 70 and between the pin 63 and the screw 65, as best illustrated in FIGS. 8 and 9. The mandrel 55 is positioned so that the bore 57 thereof is in alignment with the spring wire 26 as it exits the tension and spacing assembly 60 so that the leading end 27 of the spring wire 26 can be fed through the bore 57. The screw 65 is then tightened for urging the cam 70 back toward the washer 61 and clamping the spring wire 26 therebetween with a force determined by the adjustment of the screw 65.

The mandrel 55 is then rotated in the direction of the arrows in FIGS. 8 through 11, causing the spring wire 26 to be drawn through the tension and spacing assembly 60 under tension and wound around the mandrel 55 in a series of helical coils, the tension being determined by the adjustment of the screw 65. As the coils build up on the mandrel 55, they serve to drive the mandrel 55 axially in the direction of the arrow in FIG. 10.

The flat surface 74 of the cam 70 is spaced from the axis of the cam 70 a distance which is less than the radius of the part-cylindrical surface 73 by an amount greater than the thickness of the largest spring wire 26 which can be used with the spring winder 20. Thus, it will be appreciated that when the flat surface 74 faces the mandrel 55, as in FIGS. 8 and 9, the helical coils being wound on the mandrel 55 can pass by the flat surface 74 uninterrupted and, therefore, the helical coils will build up contiguous to one another, as at 28 in FIG. 10.

When, however, the cam 70 is rotated by means of the handle 79 to bring the leading end of the wedge 77 into facing relationship with the mandrel 55, it will be appreciated that the wedge 77 is forced downwardly between the portion of the spring wire 26 exiting the tension and spacing assembly 60 and the last coil wound on the mandrel 55, as best illustrated in FIG. 10. Since the part-cylindrical surface 73 of the wedge 77 is substantially tangent to the mandrel 55, the helical coils of the spring wire cannot slide past the wedge 77 and the helical coils are spaced apart, as at 29, by a distance which varies with the extent to which the wedge 77 is driven between the coils. It will be noted that the rotational movement of the cam 70 is accommodated by the annular recess 72 therein which permits the cam 70 to rotate relative to the pin 63. The operation continues in this manner until the desired length of spring has been wound.

The winding of the spring wire 26 around the mandrel 55 under tension imparts a permanent set to the spring wire 26 so that when it is removed from the mandrel 55 it will retain its helical spring configuration. However, there will be a certain amount of "spring-back" in the material of the spring wire so that its final inner diameter will be slightly greater than the diameter of the mandrel 55. The amount of this "spring-back" is determined by the nature of the spring wire material and the amount of tension imparted by the tension and spacing assembly 60. The wire most frequently used with the spring winder 20 is music wire made of cold drawn 1095 steel, which has a tensile strength of 230,000 to 350,000 psi., depending upon the wire size. Music wire requires no heat treating, but is frequently stress relieved at 470° F. for thirty minutes after forming. Other materials frequently used include hard-drawn 1065 steel, 302 stainless steel, oil tempered 6150 and phosphor bronze wire. Typically, springs wound with 0.040 inch music wire will have an inside diameter of 0.260 inches when wound on a 0.216 inch diameter mandrel. Similarly, that wire will have a 0.390 inside diameter when wound on a 0.308 inch mandrel and a 0.610 inch diameter when wound on a 0.435 inch diameter mandrel.

It can be seen that if the flat surface 74 is left facing the mandrel for the entire length of the spring, all the coils thereof will be contiguous and there will be formed what is commonly known as a tension spring. On the other hand, when the spring coils are spaced apart by the wedge 77, as at 29 in FIG. 10, there is formed a compression spring. These compression springs may be formed with open ends, i.e., with the predetermined spacing between coils extending along the entire length of the spring or with closed ends, wherein the first coil or two and the last coil or two are formed contiguous. For forming a closed-end spring the flat surface 74 of the cam 70 faces the mandrel 55 for the first coil or two, then the wedge 77 is rotated into the desired spacing position until the last coil or two, at which point the flat surface 74 is rotated back into facing relationship with the mandrel 55 to form the last two closed coils.

The above-described operation is, for purposes of illustration, in connection with the formation of what is commonly known as a right-hand spring. It will be appreciated that left-hand springs can also be formed with the spring winder 20. For this latter operation, the mandrel 55 is rotated in the opposite direction and a different cam 70 will be used having a helical surface 76 which winds in the opposite direction from that illustrated in the drawings.

Figure 12A:
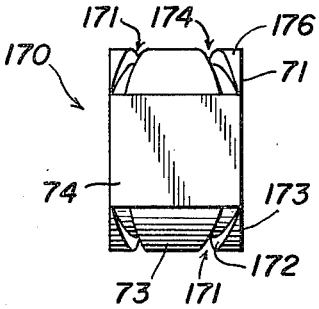
FIGS. 12A–12C are elevational views of an alternative double-helix embodiment of cam for winding either right-hand or left-hand springs, with FIG. 12A showing the flat side of the cam and FIGS. 12B and 12C respectively rotated 90° and 180° from FIG. 12A.
Figure 12B:
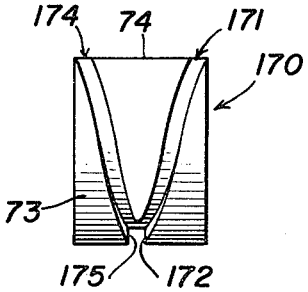
Figure 12C:
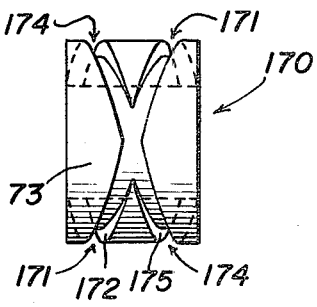

Referring now to FIGS. 12A–12C of the drawings, there is illustrated an alternative form of double-helix cam, generally designated by the numeral 170, which permits the formation of both right-hand and left-hand springs without changing cams. The cam 170 is similar to the cam 70 in that it has a part-cylindrical outer surface 73 and a flat surface 74. Formed in the part-cylindrical surface 73 is a first helical groove 171 defining a first helical bearing surface 172 which is substantially identical to the bearing surface 76 on the cam 70. This bearing surface 172 cooperates with the bearing surface 71 on the cam 170 to form a first wedge 173 for forming right-hand springs in the same manner as was described above in connection with FIGS. 1 through 11. The cam 170 also includes a second helical groove 174 which is wound in the opposite direction from the groove 171 and forms a second helical bearing surface 175 which cooperates with the end surface of the cam 70 opposite the bearing surface 172 to form a second wedge 176 for forming left-hand springs. The wedge 176 operates in the same manner as the wedge 173 except that it enters between the adjacent spring coils from below, as viewed in FIG. 10.

From the foregoing, it can be seen that there has been provided an improved and novel spring winder device which affords great simplicity and ease of operation and compactness of construction, while permitting the formation of limited numbers of a wide variety of helical springs.

While there has been described what are at present considered to be the preferred embodiments of the invention, it will be understood that various modifications may be made therein, and it is intended to cover in the appended claims all such modifications as fall within the true spirit and scope of the invention.

I claim:

1. Apparatus for forming a helical spring from a length of wire comprising a base, a mandrel, a mounting block having a pair of bores extending therethrough and having formed respectively on opposite sides thereof two parallel different size grooves each substantially V-shaped in transverse cross section and extending between said bores substantially normal thereto, two bolts respectively extending through said bores and threadedly engaged with said base for mounting said block therein, and two helical compression springs respectively surrounding said bolts and retained thereon outside of said block, said springs resiliently urging said block toward said base for holding said mandrel therebetween with said mandrel in said groove, rotation of said bolts varying the compression of said springs for varying the tightness with which said mandrel is held between said block and said base, wire feed means carried by said base for guiding an associated wire to the winding station and for applying to the wire a retarding force, said mandrel including wire-receiving means for coupling the leading end of the wire thereto at the winding station so that subsequent rotation of said mandrel causes the wire to be drawn through said feed means against the retarding force thereof under tension and wound around said mandrel in a series of helical coils thereby to advance said mandrel axially through the winding station, and variable spacing means carried by said body and engageable with the wire as it is wound around said mandrel selectively to vary the spacing between adjacent coils of wire, said winding of the wire on said mandrel against the retarding force of said feed means serving permanently to set the wire in a helical coiled configuration.

2. Apparatus for forming a helical spring from a length of wire comprising a base, a mandrel mounted on said base for rotation about a longitudinal axis of said mandrel and for axial movement through a winding station, wire feed means carried by said base for guiding an associated wire to the winding station and for applying to the wire a retarding force, said mandrel including wire-receiving means for coupling the leading end of the wire thereto at the winding station so that subsequent rotation of said mandrel causes the wire to be drawn through said feed means against the retarding force thereof and wound around said mandrel in a series of helical coils thereby to advance said mandrel axially through the winding station, and a generally cylindrical cam member carried by said base for rotation about an axis substantially parallel to the axis of said mandrel at said winding station, said cam member having a first bearing surface disposed in engagement with the wire as it exits said feed means, said cam member having a second bearing surface intersecting said first bearing surface and inclined with respect thereto at a predetermined acute angle and engageable with the last coil wound on said mandrel, said first and second bearing surfaces cooperating to form a wedge movable between minimum spacing and maximum spacing positions for varying the spacing between said first and second bearing surfaces at said mandrel thereby to vary the spacing between adjacent coils of the wire on said mandrel, said cam member having a flat surface substantially parallel to the axis thereof at the tip of said wedge, said flat surface facing said mandrel and being spaced therefrom a distance greater than the diameter of the associated wire when said wedge is in the minimum spacing position thereof so that said second bearing surface is out of engagement with the wire thereby causing adjacent coils on the mandrel to be contiguous, said winding of the wire on said mandrel against the retarding force of said feed means serving permanently to set the wire in a helical coiled configuration.

3. The apparatus set forth in claim 2, wherein said cam member has a part-cylindrical outer surface extending between said first and second bearing surfaces and having a radius such that when it faces said mandrel it is spaced therefrom a distance less than the thickness of the associated wire.

4. The apparatus set forth in claim 2, wherein said cam member has a part-cylindrical outer surface extending between said first and second bearing surfaces and having a radius such that when it faces said mandrel it is spaced therefrom a distance less than the thickness of the associated wire, said second bearing surface extending helically around said cylindrical cam.

5. The apparatus set forth in claim 2, wherein said first and second bearing surfaces converge in a predetermined direction with respect to said mandrel for cooperation therewith to effect winding of right-hand spring coils.

6. The apparatus set forth in claim 2, wherein said first and second bearing surfaces converge in a predetermined direction with respect to said mandrel for cooperation therewith to effect winding of left-hand spring coils.

7. The apparatus set forth in claim 2, wherein said cam member includes a third bearing surface intersecting said first bearing surface and inclined with respect thereto at a predetermined obtuse angle which is the complement of said predetermined acute angle, one of said second and third bearing surfaces being engageable with the last coil wound on said mandrel for cooperation therewith to effect winding of right-hand spring coils, the other of said second and third bearing surfaces being engageable with the last coil wound on said mandrel for cooperation therewith to effect winding of left-hand spring coils.

8. The apparatus set forth in claim 7, wherein said cam member has a part-cylindrical outer surface and two oppositely-pitched intersecting helical grooves formed therein, said grooves respectively defining said second and third bearing surfaces.

9. Apparatus for forming a helical spring from a length of wire comprising a base, a mandrel mounted on said base for rotation about the longitudinal axis of said mandrel and for axial movement through a winding station, a cylindrical support shaft carried by said base for axial and rotational movement, an annular first feed member rotatably mounted on said shaft coaxially therewith and having a first annular clamping surface and a pin extending from said first clamping surface substantially normal thereto and spaced radially from said shaft, a cylindrical second feed member rotatably mounted on said shaft coaxially therewith and having a second annular clamping surface disposed in facing parallel relationship with said first clamping surface, said second clamping surface having an annular recess therein for receiving said pin and accommodating rotational movement of said first and second feed members with respect to each other while said first and second clamping surfaces are spaced apart a distance less than the length of said pin, bias means carried by said shaft and cooperating therewith resiliently to urge said first and second clamping surfaces toward contact with each other, said first and second feed members being adapted to receive the leading end of an associated wire between said first and second clamping surfaces and between said pin and said shaft for clamping the wire and applying a variable retarding force thereto and guiding the wire to the winding station, movement of said shaft effecting adjustment of said bias means for varying the force by which said first and second feed members are urged together and thereby varying the retarding force applied to the wire, said mandrel including wire-receiving means for coupling the leading end of the wire thereto at the winding station so that subsequent rotation of said mandrel causes the wire to be drawn through said feed members against the retarding force thereof and wound around said mandrel in a series of helical coils thereby to advance said mandrel axially through the winding station, said second feed member having a bearing surface intersecting said second clamping surface and inclined with respect thereto at a predetermined acute angle and engageable with the last coil wound on said mandrel, said bearing surface and said second clamping surface cooperating to form a wedge movable between minimum spacing and maximum spacing positions as said second feed member is rotated on said shaft for varying the spacing between said first and second bearing surfaces at said mandrel thereby to vary the spacing between adjacent coils of the wire on said mandrel, said bearing surface being out of engagement with the wire when said wedge is in the minimum spacing position thereof thereby causing adjacent coils on the mandrel to be contiguous, said winding of the wire on said mandrel against the retarding force of said feed members serving permanently to set the wire in a helical coiled configuration.

10. The apparatus set forth in claim 9, wherein said shaft is threadedly engageable with said base, said bias means including a helical compression spring disposed coaxially with said shaft, rotation of said shaft serving to vary the compression of said spring for varying the retarding force applied to the associated wire.

* * * * *